United States Patent [19]

Norman

[11] 4,033,664

[45] July 5, 1977

[54] BATTERY TERMINAL CONNECTOR

[76] Inventor: Virgil Y. Norman, P.O. Box 164, Courtland, Calif. 95615

[22] Filed: Jan. 19, 1976

[21] Appl. No.: 650,049

[52] U.S. Cl. ..... 339/236; 339/232

[51] Int. Cl.[2] ..... H01R 11/26

[58] Field of Search ..... 339/231, 232, 236, 238, 339/240

[56] References Cited

UNITED STATES PATENTS

| | | | |
|---|---|---|---|
| 1,794,757 | 3/1931 | Cutler | 339/232 X |
| 2,551,895 | 5/1951 | Noir | 339/232 X |
| 2,648,053 | 8/1953 | Rutherford | 339/232 X |
| 2,675,532 | 4/1954 | Quick | 339/232 X |

FOREIGN PATENTS OR APPLICATIONS

| | | | |
|---|---|---|---|
| 17,549 | 5/1934 | Australia | 339/232 |

*Primary Examiner*—Roy Lake
*Assistant Examiner*—E. F. Desmond
*Attorney, Agent, or Firm*—Robert D. Farkas

[57] ABSTRACT

This disclosure pertains to a battery terminal connector adapted to manually connect a battery cable to the rod shaped terminal popularly found on vehicular storage batteries comprising a metallic housing to which the cable is electrically connected, a longitudinal hole passing through said housing, having a gradually diminishing diameter tapered hole at one end thereof. A hollow rod-like conducting resilient material having a truncated cone-like shape whose apex is adjacent the cylindrical end thereof has two or more longitudinal notches located in the truncated conical surface, permitting the walls thereof to be drawn inwardly radially as the conical exterior surfaces are drawn into the tapered hole of the longitudinal opening in the housing. The battery post or terminal is grasped by the opening at the base of the conical section. A spring and bolt assembly causes the cone shaped grasping insert to be urged into the tapered hole.

9 Claims, 3 Drawing Figures

BATTERY TERMINAL CONNECTOR

BACKGROUND OF THE INVENTION

1. The Field of the Invention

This invention relates to electrical connectors and more particularly to that class of connectors utilized to provide electrical connections between one end of a battery cable and a terminal of a storage battery used in vehicles of all sorts.

2. Description of the Prior Art

The prior art abounds with a variety of devices adapted to provide secure electrical connections between battery cables and battery posts. Each device requires the use of tools or other devices to insure an adequate vibration resistant electrical connection therebetween.

SUMMARY OF THE INVENTION

A battery cable comprising a single conductor is electrically connected to a small longitudinal housing element having a longitudinal opening therethrough. One end of the opening is adapted with a tapered hole whose inside diameter decreases as the hole approaches the other end of the longitudinal opening. An inwardly compressible metallic terminal gripping element is adapted with a conical shape at one end of a cylindrical portion of the length thereof. The conical surface has at least two longitudinal notches extending from the base of the cone to the intersection of the apex of the cone and the cylindrical portion of the length of the compressible metallic terminal gripping element. The cylindrical portion of the length has a threaded cylindrical hole therethrough and the base of the conical section is adapted with an inwardly turned lip having two or more segments with serrated teeth thereon that can effectively electrically connect to a rod shaped battery terminal when the conical end of the gripping element is drawn into the tapered opening in the housing by a helical spring exerting a force along the longitudinal axis of the cone shaped surface upon the shoulder of a bolt whose threads are threadedly inserted into the cylindrical hole of the gripping element. The lowermost end of the helical spring rests upon an inwardly turned lip formed at the end of a spring retaining cup having an external lip at the other end thereof. The retaining cup is inserted into the other end of the longitudinal opening of the housing having its flanged lip rest upon the surface through which the other end of the lateral opening is located. Depressing the bolt forces the conical surface of the gripping element outwardly from the tapered hole in the longitudinal opening of the housing such that the spring characteristics of the gripping element causes the inwardly turned lip edges to move radially outwardly from the longitudinal axis of the gripping element, locating thereby the contacting teeth outwardly from a position in which they may effectively contact the battery terminal during the time that the battery terminal connector is being inserted on or removed from the connected position.

A primary object of the instant invention is to provide a battery terminal connector which does not require tools to effectively electrically connect or disconnect a battery cable to a battery post.

Another object is to provide a battery terminal connector with increased inwardly directed contacting forces as the housing thereof is forced to move towards the battery housing.

Still another object is to provide a battery terminal connector having barbs or protrusions therein which insure an efficient battery terminal connection.

A further object is to provide a battery terminal connector which enables the battery cable to be disposed above and away from the uppermost surface of the battery housing precluding thereby corrosion attacking the battery end of the battery cable.

These objects, as well as other objects of this invention, will become readily apparent after reading the following description of the accompanying derawings.

DESCRIPTION OF THE PREFERRED EMBODIMENT

The structure and method of fabrication of the present invention is applicable to a metallic housing adapted to electrically connect to one end of a single conductor battery cable having a longitudinal opening therethrough. One end of the longitudinal opening is a tapered hole adapted to receive the conical exterior surfaces of a gripping element. The gripping element has vertical notches located in the conical end thereof such that drawing up the conical surface into a similarly shaped hole permits the widest end to be reduced in diameter. An inward turned lip is adapted with serrations located at the widest portion of the conical surface and is designed to grasp the battery post. The other end of the gripping element is cylindrical in shape having a longitudinal hole threaded therein. A bolt having a push button-like head is threaded into the non-conical end of the gripping element and is forced longitudinally away from the housing by a helical spring. One end of the spring rests on the shoulder of the push button-like head of the bolt while the other end rests on a retaining cup that is inserted into the non-conical shaped hole end of the metallic housing. The retaining cup is adapted with an inwardly turned lip, which supports the spring, and an outwardly turned flange-like lip designed to prevent the retaining cup from sliding within the housing. The outward longitudinal force exerted by the spring is of sufficient magnitude to cause inward forces to be exerted by the walls of the tapered hole on the conical shaped end of the gripping element, causing a reduction in the diameter in the gripping element's lip grasping opening.

Depressing the push button end of the bolt manually compresses the spring and forces the tapered end of the gripping element to protrude outwardly from the tapered hole. The gripping element is fabricated from a spring-like material so that the opening at the end of the gripping element, in its extended position, is large enough to permit a standard vehicular wet battery terminal post to be inserted therein. Releasing the push button-like head of the bolt permits the spring to automatically bias the gripping element inwardly, reducing the gripping lip opening diameter and thereby, permitting effective grasping of the battery post. Turning the push button cap relative to the housing alters the spacing between the shoulder of the push button-like head of the bolt and the retaining lip of the retaining cup, thereby altering the inward force exerted on the gripping element. When the bolt is turned in the direction to fully compress the spring, the forces compressing the lip of the gripping element are at a maximum.

Figure 1:
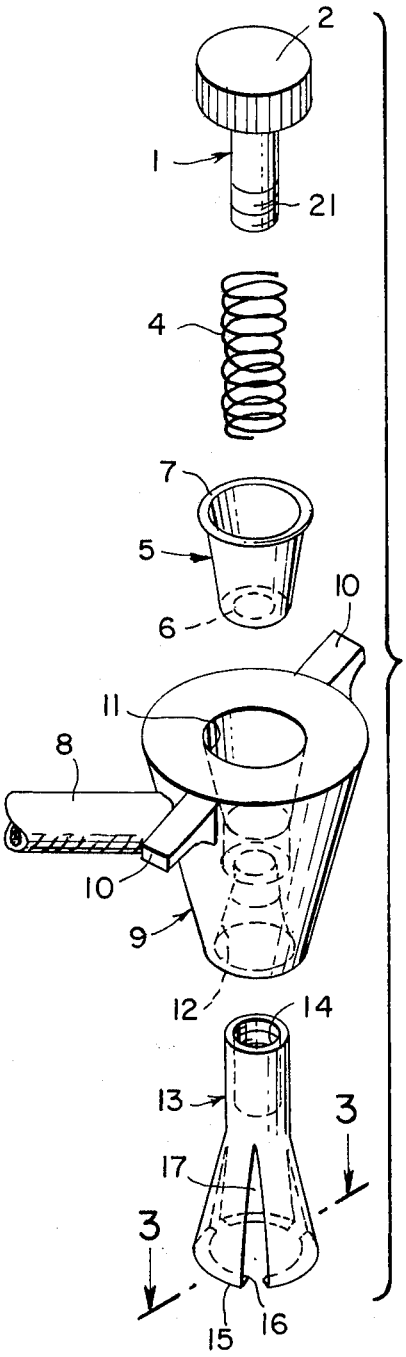
FIG. 1 is a composite illustration of the perspective views of the battery terminal connector showing a retaining bolt, helical spring, retaining cup, housing attached to a partial length of a battery cable, and a battery gripping element.

Now referring to the Figures, and more particularly to the embodiment illustrated in FIG. 1 showing a bolt 1 adapted with a push button-like cap 2 and external threads 21 on the free end of the cylindrical shaft thereof. The helical spring 4 has a longitudinal hole which permits the insertion of the cylindrical body of bolt 1 therein. Retaining cup 5 is shown with an external flange-like lip 7 at one end. The other end is adapted with an internally directed lip 6 surrounding an opening through which the cylindrical body of bolt 1 may pass. Metallic housing 9 is fitted to connect electrically to one end of a battery cable 8 and has an opening 11 through which the retaining cup 5 may pass. Flange-like lip 7 of the retaining cup 5 is designed to rest on the lateral surface surrounding opening 11. Wings 10 are designed to be grasped by the four fingers of the user permitting the thumb to exert an inward force upon the top end of the push button-like cap 2 of bolt 1. A tapered hole 12 at the other end of the housing 9 is adapted to receive the gripping element 13. Internal threads 14 threadingly engage threaded 21 on bolt 1. The widest opening 15 at the base of the conical end of the gripping element 13 is interrupted by a number of notches 17. An inwardly turned lip 16 is located at edge 15 corresponding to the base of the conical section whose slope matches the taper at opening 12.

Figure 2:
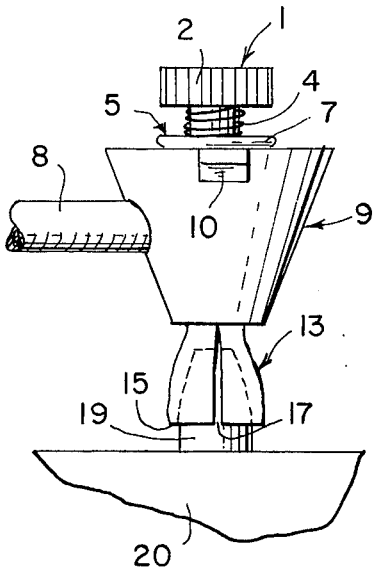
FIG. 2 is a side elevation view of an assembled battery terminal connector electrically connected to a battery terminal shown on a portion of the uppermost lateral surface of a battery.

FIG. 2 illustrates the housing 9 and a partial length of an electrical cable 8 protruding therefrom. Retaining cup 5 has been inserted into opening 11 as shown in FIG. 1. Flange-like lip 7 is shown resting on the uppermost lateral surface of the housing 9. Spring 4 is illustrated surrounding the exposed shank of bolt 1 with its uppermost end resting on the shoulder of push button-like cap 2. Gripping element 13 protrudes outwardly from the lowermost lateral surface of the housing 9. A fragmented section of a battery 20 is shown with its post 19 inserted into the open end of gripping element 13.

Figure 3:
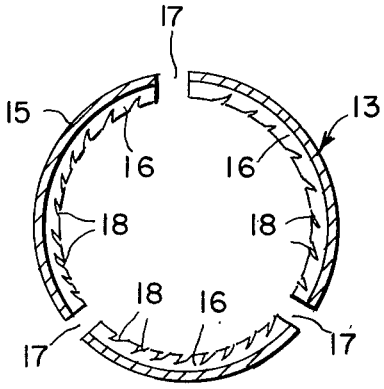
FIG. 3 is a cross-sectional view taken along line 3—3 viewed in the direction of arrows 3—3 illustrating the interior serrated lip at the base of the conical end of the battery terminal connector gripping element as shown in FIG. 1.

FIG. 3 illustrates the cross-sectional view taken along line 3—3 viewed in the direction of arrows 3—3 of the finger gripping element as shown in FIG. 1. FIG. 3 illustrates notches 17 interrupting edge 15 upon which inwardly turned lip 16 is located. Serrations 18 are formed on the innermost surface of lip 16 and are utilized to facilitate good electrical connection to battery post 19 as shown in FIG. 2.

One of the advantages is a battery terminal connector which does not require tools to effectively electrically connect or disconnect a battery cable to a battery post.

Another advantage is a battery terminal connector with increased inwardly directed contacting forces as the housing thereof is forced to move towards the battery housing.

Still another advantage is a battery terminal connector having barbs or protrusions therein which insure an efficient battery terminal connection.

A further advantage is a battery terminal connector which enables the battery cable to be disposed above and away from the uppermost surface of the battery housing precluding thereby corrosion attacking the battery end of the battery cable.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited not by the specific disclosure herein, but only by the appending claims.

The embodiment of the invention in which an exclusive privilege or property is claimed are defined as follows.

I claim:

1. A battery terminal connector comprising a housing adapted to electrically contact a conductor, said housing adapted with a longitudinal opening therethrough, a spring retainer cup adapted to coaxially engage the interior of said housing at one end of said longitudinal opening, said cup having an opening therein, said spring retainer cup having a flange extending radially outwardly at one end of said opening and a lip extending radially inwardly at the other end thereof, a helical spring having an outside diameter smaller than said opening and larger than a port formed by the interior edges of said lip, a push button having one end of a longitudinal shaft fixedly secured normally thereto, the other end of said longitudinal shaft adapted with external threads thereupon, said opening having upper and lower tapered portions and an intermediate cylindrical portion, a battery terminal gripping element having a first portion of the length thereof adapted with a coaxial threaded hole within a cylindrically shaped external surface, said external threads adapted to threadingly engage within said threaded hole, a second portion of the length of said battery terminal gripping element adjacent said first portion having an outside diameter at the free end thereof greater than the outside diameter of said battery terminal gripping element at the intersection of said first and said second portions of the lengths thereof, a battery terminal opening within said second portion of the length of said battery terminal gripping element formed by the walls thereof adapted with a plurality of notches extending longitudinally from said free end thereof, said battery terminal gripping element fabricated from a conducting material and adapted to electrically connect to said housing and said conductor.

2. The battery terminal connector as claimed in claim 1 further comprising a lip located at the said free end of said second portion of the length of said battery terminal gripping element extending partially radially inwardly therefrom.

3. The battery terminal connector as claimed in claim 2 wherein the innermost edges of said lip are serrated.

4. The battery terminal connector as claimed in claim 1 further comprising a plurality of spaced partially radially inwardly extending battery terminal gripping protrusions located on the interior surface of said walls.

5. The battery terminal connector as claimed in claim 4 wherein at least one of said protrusions is adapted to have a barb-like shape at the free end thereof.

6. The battery terminal connector as claimed in claim 1 further comprising at least one flange-like finger gripping shoulder extending radially outwardly from the exterior surface of said housing.

7. The battery terminal connector as claimed in claim 1 wherein said walls are substantially uniform in thickness.

8. The battery terminal connector as claimed in claim 1 wherein the walls adjacent said battery terminal opening within said second portion of the length of said battery terminal gripping element having substantially a conical shape coaxially aligned with said cylindrically shaped external surface, said walls having a conically shaped exterior surface partially slidably engaging within one end of said opening in said housing.

9. The battery terminal connector as claimed in claim 1 wherein said push button is fabricated from a colored plastic material.

* * * * *